US005471110A

United States Patent [19]

van der Leeuw et al.

[11] Patent Number: 5,471,110

[45] Date of Patent: Nov. 28, 1995

[54] HIGH PRESSURE DISCHARGE LAMP HAVING FILAMENT ELECTRODES

[75] Inventors: Bart van der Leeuw, Hammondsport; Joseph E. Canale, Painted Post; Albert E. Kowal, Savona, all of N.Y.; Henrikus J. H. Pragt, Eindhoven, Netherlands; Thomas W. Morris, Bath, N.Y.

[73] Assignee: Philips Electronics North America Corporation, New York, N.Y.

[21] Appl. No.: 126,834

[22] Filed: Sep. 24, 1993

Related U.S. Application Data

[63] Continuation-in-part of Ser. No. 994,752, Dec. 22, 1992, abandoned.

[30] Foreign Application Priority Data

Dec. 23, 1991 [EP] European Pat. Off. ..... 91203379

[51] Int. Cl.[6] ..... H01J 61/073; H01J 61/22; H01J 61/36

[52] U.S. Cl. ..... 313/25; 313/27; 313/47; 313/44; 313/571; 313/574; 313/632; 313/641; 313/642

[58] Field of Search ..... 313/25, 27, 44, 313/47, 491, 571, 574, 620, 628, 631, 632, 635, 642, 643, 311, 344, 633, 640, 641

[56] References Cited

U.S. PATENT DOCUMENTS

| | | | |
|---|---|---|---|
| 2,530,394 | 11/1950 | Lowry et al. | 313/344 X |
| 2,654,045 | 9/1953 | Wright | 313/344 X |
| 2,845,557 | 8/1956 | Gottschalk | 313/25 |
| 3,462,631 | 8/1969 | Hashimoto et al. | 313/344 X |
| 3,911,308 | 10/1975 | Akutsu et al. | 313/567 |
| 3,937,996 | 2/1976 | Cap | 313/631 |
| 3,979,624 | 9/1976 | Liu et al. | 313/575 |
| 4,232,243 | 11/1980 | Rigden | 313/623 |
| 4,247,798 | 1/1981 | Howe et al. | 313/623 |
| 4,320,322 | 3/1982 | Rothwell, Jr. et al. | 313/621 |
| 4,709,184 | 11/1987 | Keeffe et al. | 313/638 |
| 4,721,876 | 1/1988 | White et al. | 313/25 |
| 4,866,342 | 9/1989 | Ramaiah et al. | 313/640 X |
| 4,888,517 | 12/1989 | Keeffe et al. | 313/25 |
| 4,929,863 | 5/1990 | Verbeek et al. | 313/638 X |
| 4,935,668 | 6/1990 | Hansler et al. | 313/640 X |
| 4,963,790 | 10/1990 | White et al. | 313/25 |
| 5,043,623 | 8/1991 | Scholz et al. | 313/25 |
| 5,109,181 | 4/1992 | Fischer et al. | 313/639 X |
| 5,136,204 | 8/1992 | Muzeroll et al. | 313/25 |

FOREIGN PATENT DOCUMENTS

| | | |
|---|---|---|
| 0361530 | 4/1990 | European Pat. Off. . |
| 0475381 | 3/1992 | European Pat. Off. . |
| 2201860 | 8/1990 | Japan . |

OTHER PUBLICATIONS

Lamp Catalog and Technical Guide 1991–1992 Brochure, pp. 1–48.

*Primary Examiner*—Sandra L. O'Shea
*Assistant Examiner*—Ashok Patel
*Attorney, Agent, or Firm*—Brian Wieghaus

[57] ABSTRACT

A high pressure discharge lamp having a discharge vessel with opposing end chambers includes discharge electrodes each consisting of an open elongate filament of refractory metal wire having a plurality of succesive coil turns extending transverse to the longitudinal axis of the discharge vessel. The filament electrodes are dimensioned so that the discharge arc which terminates thereon is sufficiently retracted into the end chamber of the discharge vessel so that the fill constituents condense on a region of the discharge vessel which is primarily axially between the filament electrodes. In a favorable embodiment, the lamp is a metal halide lamp in which the electrode and the discharge sustaining fill is free of thoria and its compounds.

34 Claims, 4 Drawing Sheets

HIGH PRESSURE DISCHARGE LAMP HAVING FILAMENT ELECTRODES

CROSS-REFERENCE TO RELATED APPLICATIONS

This is a continuation-in-part of U.S. application Ser. No. 994,572 filed Dec. 22, 1992, now abandoned, entitled "Electric Discharge Lamp" of Henrikus J. Pragt which discloses and claims a containment shield for a high pressure discharge lamp having a coiled length of spring wire about a glass sleeve. This application relates to U.S. application Ser. No. 08/126,820 of Bart van der Leeuw et al, filed concurrently herewith, entitled "High Pressure Discharge Lamp Having a Pinched-on Containment Sleeve" which discloses and claims a high pressure discharge lamp having a containment sleeve pinched to the side faces of the discharge vessel press seals. The application also relates to U.S. application Ser. No. 08/126,835, filed concurrently herewith, of Bart van der Leeuw et al entitled "High Pressure Discharge Lamp Having a Clamped-on Containment Sleeve" in which the containment sleeve is clamped to the discharge vessel with electrically isolated feed-throughs extending from the press seals.

BACKGROUND OF THE INVENTION

The invention relates to a high pressure discharge lamp having a discharge vessel with opposing end chambers and a longitudinal axis, a discharge sustaining filling within said discharge vessel, and a pair of opposing discharge electrodes arranged in said end chambers and between which a discharge is maintained during lamp operation.

Such lamps are well known in the art and include, for example, mercury vapor and metal halide lamps. The discharge vessel for these lamps is typically of quartz glass (fused silica). Mercury lamps include a fill of mercury and a rare gas while metal halide lamps further include one or more metal halides which contribute to the emission spectrum of the lamp.

The fused silica discharge vessels of high wattage metal halide lamps (i.e. 250–400 W) are typically formed from a circular-cylindrical tube of this material and include press seals at each end formed by collapsing the tube ends with opposing press jaws. The discharge vessel has a center tubular portion, which retains the circular cross-section of the tube, and opposing end chambers of continuously reducing cross section which result from pressing of the press seals. The end chambers also include crevices at the region of the press seal which are formed as a result of the pressing process.

The conventional electrode which is in almost universal use for commercially available HID lamps includes a tungsten rod around which is wound a tungsten coil structure. The electrode rod protrudes from the coil and terminates at a tip to which the discharge arc attaches. The coil structure also facilitates starting and disposes of heat by thermal radiation. Various electrodes of this type are shown in the book *High Pressure Discharge Lamps* by W. Elenbaas, Philips Technical Library, Chapter 4, Section 2.2, pp. 116–117. The electrode rod is typically aligned with the longitudinal axis of the discharge vessel.

In high pressure discharge lamps, the photometric parameters (luminous efficacy, color rendering, color temperature) are dependent on the partial gas pressures of the fill constituents. The gas pressures, in turn, are primarily controlled by the surface temperature of the discharge vessel in the area at which the vapor condenses. In mercury and metal halide lamps the fill constituents are generally over dosed by a factor of about 100, i.e. during operation 1/100 th of the amount dosed is present in the vapor phase. The overdose fills up crevices in the area of the pinch and ensures that the salts condense at a location which is warmer than in the crevices. The condensing fill constituents coming out of the vapor phase, halide salts in the case of metal halide lamps, condense on the inner discharge vessel wall as liquid droplets of various sizes varying from a film like material to drops of about 1 mm. In a vertically operated metal halide lamp with conventional electrodes, the excess salts will condense in the lower end chamber at a location located axially between the electrode tip and the end of the end chamber. Some of the condensed liquid typically runs down the wall and pools in the crevices behind the electrode.

The temperature of the area where the fill condenses is influenced significantly by how close the discharge arc, determined by the inserted length of the electrode tip, is spaced from the end of the end chamber. The inserted length is determined by such factors as the number of coil turns necessary for holding a sufficient quantity of emitter material and/or for cooling the electrode rod, the spacing between the distal tip of the electrode rod and the adjacent coil turn to ensure that the arc attaches at the distal tip and not the coil, and the spacing of the rear-most coil turn from the wall of the end chamber to prevent spontaneous color burst caused by excess salts contacting the coil. Additionally, if the electrode is too short the heat conducted down the electrode rod from the discharge arc into the seal area will cause the fused silica to recrystallize and shorten lamp life through seal failure. These considerations place a practical limit on how much a conventional electrode can be shortened while still maintaining lamp integrity. The inserted length of the distal tip of a conventional electrode from the end chamber wall behind the electrode is typically on the order of several mm, for example 3–5 mm, for commercially available lamps.

The wall temperatures of the discharge vessel necessary to achieve acceptable lamp performance are generally not obtained in lamps with conventional electrodes solely through heating by the discharge arc. Rather, the wall temperature is increased according to one technique by providing the outside of the end chamber with a heat conserving coating of, for example, zirconium oxide. Such coatings are on almost all commercially available metal halide lamps. However, they are a disadvantage because they increase the cost of the lamp merely by their application. They are also the source of problems such as poor adhesion and discoloration, as well as being a source of spread in photometric results. Another technique is too provide a light-transmissive sleeve closely spaced about the discharge vessel, as is known from U.S. Pat. No. 4,888,517 (Keefe et al).

During the early 1980's, interest in low wattage (35–100 W) metal halide lamps rapidly developed, particularly as replacements for incandescent and halogen lamps for general interior and display lighting. The discharge vessels for early low wattage lamps were basically smaller versions of conventional high wattage discharge vessels and included conventional discharge electrodes of reduced size. The performance of these early low-wattage lamps was inferior to the efficacy (LPW) and color rendering (CRI) values in the region previously established for high wattage lamps, especially in the smaller 50 W and 70 W sizes. It was found that luminous efficacy and color rendering generally decreased as the size and wattage of the discharge vessel were reduced.

Later efforts to improve the performance of low wattage lamps concentrated mainly on discharge vessel shaping and miniaturization of the end chambers and press seals. Formed-body discharge vessels, with precise elliptical or ovoidal bodies to provide a more nearly isothermal operation, resulted from these efforts. Such a discharge vessel is known, for example, from U.S. patent application Ser. No. 423,904 filed Oct. 19, 1989. These discharge vessels are of high quality, but are more expensive to manufacture than discharge vessels pressed from straight tubing. Shaping of the formed body requires repetitive, time consuming glass working steps which are not required for straight body discharge vessels.

On rare occasions, the discharge vessels of metal halide lamps may rupture with sufficient force to cause failure of the outer envelope. Accordingly, for lamps intended for open fixtures which do not have a separate cover to contain glass fragments (typically low wattage lamps), it is known to provide a containment sleeve around the discharge vessel to prevent failure of the outer envelope. Such a lamp is known from U.S. Pat. No. 5,136,204. The presence of the sleeve, however, complicates lamp construction because it must be supported about the discharge vessel. In the commercially available lamp according to this patent, the sleeve is quartz glass and has a wall thickness of 2 mm. Metal clips are secured on the press seals and include portions which hold the ends of the sleeve. The sleeve and discharge vessel are supported by welding the clips to an elongate metal support rod which is fixed around the lamp stem by a metal strap. The support rod, and consequently the metal clips and the sleeve, are electrically isolated which prevents accelerated sodium depletion from the discharge vessel. (For a detailed description of this sodium loss process, reference may be made to the textbook *Electric Discharge Lamps* by Dr. John Waymouth, M.I.T. Press 1971 (Chapter 10)). As compared to a typical nonshielded lamp in which the elongate support rod is welded to a stem conductor or is sealed in the stem to carry current to the discharge vessel, the fixing of the support rod to the stem with a metal strap is more expensive and intricate. The clips further add to the number of lamp parts and increase lamp cost.

From U.S. Pat. No. 4,721,876 it is known to surround a glass containment sleeve with a meshwork of metal wire which is fixed around the tube with metal clamping strips. The meshwork increases the containment capability of the sleeve. The sleeve is supported by clamping strips which are electrically conducting and connected to a lamp frame which supports the discharge vessel and connects the discharge electrodes to a source of electrical potential. The meshwork as a result is not electrically isolated, which can lead to the disappearance of sodium from the discharge vessel. The manufacture of the meshwork, or of a braided assembly, and its manipulation are also difficult.

FIG. 1 shows a discharge vessel/containment shield assembly 1 for a low wattage metal halide lamp which has been publicly disclosed by Venture Lighting Company. The discharge vessel is of the previously mentioned formed-body type in which the body portion 6, which lies between the press seals and in which the discharge is maintained, has a precise elliptical or ovoidal shape. One end 3 of the containment sleeve is open while the other end 4 is fused to both major faces of one of the press seals 5. The fusing of the sleeve to one of the discharge vessel press seals is advantageous because no additional metal parts are introduced into the lamp envelope. However, as compared to designs which use straps or clips to hold the sleeve, the containment provided by the construction of the lamp of FIG. 1 was found to be insufficient. The wall thickness of the sleeve in the lamp of FIG. 1 was 2 mm. In tests in which the discharge vessel was ruptured by a current surge, failure of the outer envelope was found to occur. Additionally, the sleeve construction is asymmetric in that the pinched end of the sleeve is totally closed whereas the other side is open. The lower end of the discharge vessel will thus have a significantly different temperature, and the lamp will have different photometrics, depending on whether the lamp orientation is base-up or base-down, which is undesirable.

While there are numerous combinations of metal halides which can be used in metal halide lamps, those which have enjoyed commercial success fall into two main categories. The thallium-indium-sodium combination offers excellent color rendering properties and has enjoyed commercial success in Europe. In the United States, the sodium scandium lamp has become practically universally accepted, due to its very good luminous efficacy, (typically 85 to 90 lumens per watt for lamps in the 250–400 W range) and long operating life (typically 10,000 to 15,000 hours).

Commercially available metal halide lamps universally include thorium either in the tungsten electrode, the fill material, or both. In the thallium-containing metal halide lamps, the electrodes carry an emitter material of thorium oxide retained in a reservoir formed by the turns of the tungsten coil structure. In operation, the thorium oxide is believed to decompose slightly and release free thorium to supply a monolayer film having reduced work function and higher emission. Unfortunately, this cathode cannot be used in a scandium-containing lamp because the $ScI_3$ is converted to $Sc_2O_3$, resulting in loss of essentially all the scandium in a relatively short time. Instead, a thoriated tungsten electrode is used in an iodide-containing atmosphere. Under proper conditions the thoriated rod serves as a good electron emitter. Additionally, it is also known to provide thorium iodide in the fill material, which supports a transport cycle which returns to the electrode any thorium lost to the discharge. The thorium-tungsten electrode and its method of operation are described in the book *Electric Discharge Lamps* by John F. Waymouth, M.I.T. Press, 1971, Chapter 9.

The use of thorium is a disadvantage in that it is a radioactive material, which creates serious problems during manufacture of thoriated tungsten electrodes and/or in dosing thorium iodide and thorium tetraiodide into the discharge vessel. For example, when thoriated tungsten electrodes are etched during their manufacture, thorium is dissolved in the etch liquid, making it a radioactive waste.

Without thorium, however, metal halide lamps with conventional electrodes have been found to experience rapid blackening of the discharge vessel. Electrodes without thorium have a high work function. The electrode must then run hotter to sustain the arc current, which causes an increase in tungsten evaporation from the electrode and unacceptable discharge vessel blackening within several hundred hours. This adversely effects lamp performance by reducing lumen maintenance and leads to reduced lamp life. The thorium layer is also critical because it protects the tungsten electrode from corrosion.

U.S. Pat. No. 3,937,996 (Cap) discloses a high wattage metal halide lamp which uses electrodes of refractory metal wire formed into large open loops and which do not include an electrode rod. The patent specifically teaches that the discharge vessel fill must include a metal compound of low work function which is pyrolitically decomposable and subject to plating out in the electrodes and which participates in a transport cycle which continuously returns the low work function metal to the electrode. In the disclosed embodiment, the discharge sustaining fill includes thorium iodide and thorium tetraiodide to maintain the thorium transport cycle discussed above.

In the early 1990's, the market calls for more cost effective low-wattage metal halide lamp designs which can safely be used in open fixtures. However, cost reduced lamps will only be commercially successful if the photometrics of the lamps are acceptable. For low-wattage metal halide lamps to be considered "standard quality", the efficacy should be greater than about 80 LPW for 100 watt lamps, greater than about 75 for 70 watt lamps and greater than about 65 for 50 watt lamps. The CRI should be greater than about 60.

It is the object of the invention to provide a high pressure discharge lamp, and particularly a low wattage metal halide lamp, which is of a simple, less costly and reliable construction while providing commercially acceptable photometrics.

SUMMARY OF THE INVENTION

The above object is accomplished in a first embodiment of the invention in that a high pressure discharge lamp of the type described in the opening paragraph is characterized in that:

the discharge electrodes each consist of an open elongate filament of refractory metal wire having a plurality of successive coil turns extending transverse to the longitudinal axis of the discharge vessel, the dimensions of the electrode and the spacing of the coil turns from the end chamber being selected such that the discharge arc sufficiently heats the end chamber during lamp operation so that the fill constituents primarily condense on the discharge vessel at a location primarily axially between the discharge electrodes with the disharge vessel oriented vertically.

The invention is based on the discovery that a filament electrode having a coil body which extends transverse to the longitudinal axis of the discharge vessel can retract the arc further into the end chamber without detracting from lamp integrity than a conventional, longitudinally extending discharge electrode. It has been found that a filament electrode can improve the photometric parameters of a high pressure discharge lamp to the same extent as providing either a heat conserving end coating or a heat conserving sleeve. This improvement is clearly evident when the filament is dimensioned so that the arc terminates thereon within about 2 mm from the wall of the end chamber as measured along the longitudinal axis of the discharge vessel. Thus, the filament electrode serves as a tool to further improve lamp performance. Alternatively, lamp performance can be maintained while reducing cost by eliminating the heat conserving end coating or sleeve and substituting the filament electrode for a conventional electrode.

Because the filament coil is not wound on an electrode rod it has an open structure and there are no crevices that absorb fluid salts by capillary action. Thus, it has been found that the filament coil may be positioned closer to the end wall of the end chamber than the end turn of conventional electrodes without spontaneous color burst occurring. The deep retraction into the end chambers also means that the arc gap can be made longer for an otherwise unchanged arc tube dimension. Since the mercury dose may be reduced due to the increased arc gap, lower mercury doses may be used in the lamp according to the invention, which is advantageous for the environment. Additionally, increasing the arc gap decreases the wall loading (watts/cm$^2$) between the electrodes, which leads to improved lumen maintenance.

In a metal halide lamp according to a favorable embodiment, the filament electrodes are free of thoria and the fill material is free of metal compounds of low work function, such as thorium tetraiodide, which are pyrolitically decomposable and subject to plating out on the electrodes during lamp operation. The absence of thorium and its compounds from the lamp eliminates the manufacturing problems associated with this radioactive material and is particularly advantageous for the environment. It was discovered that the lamp according to this embodiment experienced blackening of the discharge vessel only at about the same rate as a sodium-scandium metal halide lamp with conventional electrodes of thoriated tungsten. This was especially surprising because lamps with conventional electrodes without thoria in the electrode and in the fill material have been found to have excessive end blackening after only several hundred hours. Additionally, the above-mentioned U.S. Pat. No. 3,937,996 in which the electrode does not include an electrode rod also specifically teaches that such a low work function metal must be included in the fill material and participate in a transport cycle to replenish tungsten lost from the electrode.

According to another embodiment of the invention, the discharge vessel is also free of a heat conserving coating on the end chambers. Because of the increased heating of the end chamber of the discharge vessel by the discharge arc due to the deeper retraction of the filament electrode into the end chamber, it has been found that the sufficiently high wall temperatures can be reached such that the same or better photometry values can be achieved with a filament electrode and no end coat as with a conventional electrode and end coat. Elimination of the end coat without reducing photometric performance is particularly advantageous because end coats add to lamp cost and contribute to significant lamp-to-lamp variations in photometric parameters as previously discussed. Additionally, it was discovered that eliminating the end coat also lead to improvements in lumen maintenance.

According to yet another embodiment of the invention, a low wattage metal halide lamp has a discharge vessel with end chambers of continuously reducing cross-section in which filament electrodes are arranged and a tubular portion of a substantially constant, preferably circular, cross-section between the end chambers. This has the significant advantage that low wattage metal halide lamps can now be made out of straight tubing with conventional press jaws and without an end coat while achieving "standard quality" photometric performance.

In still another embodiment, the high pressure discharge lamp includes a light transmissive sleeve closely arranged about the discharge vessel. The sleeve further increases the operating temperature of the discharge vessel and contains fragments of the discharge vessel in the rare event of discharge vessel rupture. Favorably, the sleeve is pinched to the press seals along only the minor faces of the press seal. With this construction, both ends of the sleeve may remain open. Thus, the problems of asymmetry associated with pinching the sleeve along the major faces of only one seal as in the prior art is obviated. Additionally, pinching the sleeve against the side faces, especially along the side faces of both seals, provides a sturdy construction in which clamping strips or clips can be eliminated. Thus, a single, low cost, symmetric construction is obtained which overcome the above-noted disadvantages of the prior art.

These and other objects, features, and advantages of the invention will become apparent with reference to the following drawings, detailed description, and claims.

DESCRIPTION OF THE PREFERRED EMBODIMENT

Figure 2:
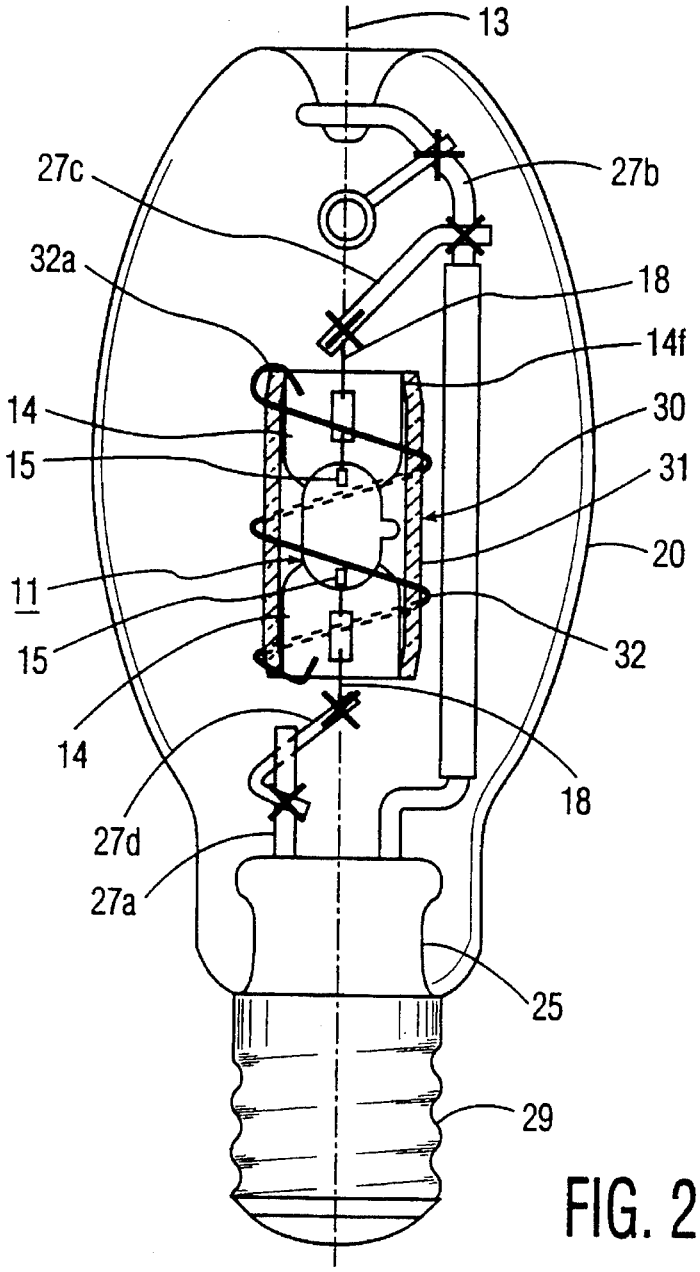
FIG. 2 illustrates a low wattage metal halide lamp according to the invention including a containment shield around the discharge vessel.

FIG. 2 shows a high pressure discharge lamp having a sealed outer envelope 20 in which a discharge vessel 11 is arranged. Conductive support rods 27 *a,b* extend in a conventional manner from the lamp stem 25 and are connected to lamp cap 29 outside the outer bulb and to respective ones of the discharge vessel feed-throughs 18 via conductive straps 27 *c,d*. During lamp operation an electric potential is applied across the discharge electrodes 15 via the conductive support rods 27 *a,b*, the straps 27 *c,d*, and the feed-throughs 18 and a gas discharge is maintained between the discharge electrodes 15.

Figure 3:
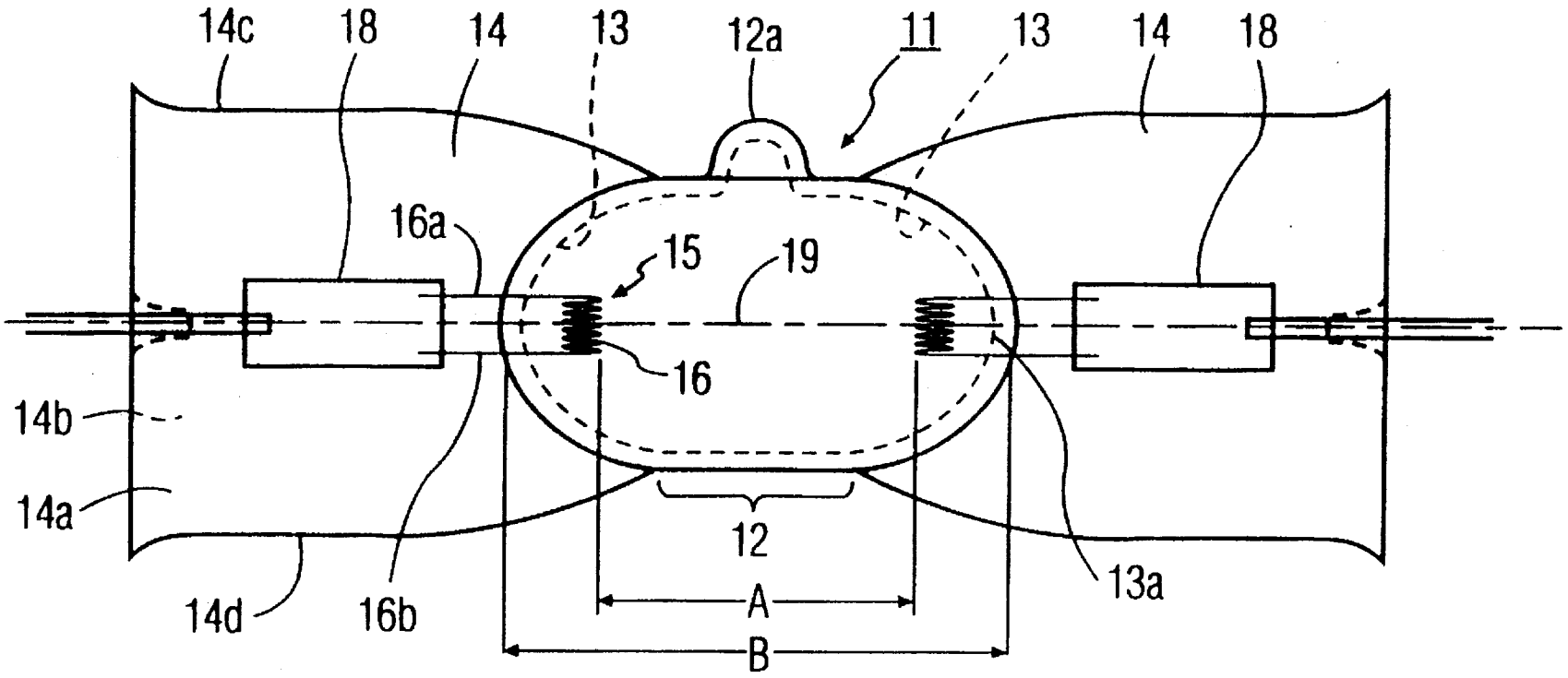
FIG. 3 is an elevation of the low-wattage metal halide discharge vessel according to the invention.

FIG. 3 shows the discharge vessel 11 in greater detail. The discharge vessel is formed from a length of straight circular-cylindrical tubing of fused silica (quartz glass) and includes opposing planar press seals 14, pressed in a conventional manner with press jaws, which seal the discharge vessel in a gas-tight manner. Between the press seals 14, the discharge vessel includes a central, tubular portion 12 of a constant circular cross-section and end chambers 13 of continuously reducing cross-section which result from the pressing of the seals 14. Each of the seals 14 has a pair of opposing major faces (14*a*, 14*b*) and a pair of minor, side faces (14*c*, 14*d*) extending between the major faces. The portion 12 further includes a tipped-off tubulation 12*a* from an exhaust tube which is used for exhausting and filling the discharge vessel in a known-fashion.

A discharge sustaining filling within the discharge vessel includes mercury, an inert gas and a metal halide. The filling is free of compounds of metals of low work function which are pyrolitically decomposable and subject to plating out on the electrodes during lamp operation. As used herein, compounds of metals of "low work function" are any metal compounds which have a work function of about that of sodium tetraiodide or lower.

The discharge electrodes 15 are arranged in the end chambers 13 and are open filaments which consist of a length of refractory metal wire, in this instance tungsten, formed into coil turns 16 which define a coil body. (FIG. 3) The legs 16*a, b* of the electrodes are welded to conventional foliated feed-throughs 18 which extend through a respective press seal 14 to the exterior. The coil body extends transverse to the longitudinal axis 19 of the discharge vessel. In contrast to conventional discharge electrodes for high pressure discharge lamps, the electrodes 15 do not have an electrode rod so the coil body is open. Due to the absence of the electrode rod, there are no crevices in which the metal halide salts can pool. The electrodes are free of thoria and free of an emitter material.

During lamp operation there is the very remote possibility that the discharge vessel may explode, for example, because of a power surge. Such explosions have been found to have sufficient force to rupture the outer envelope. In order to contain fragments of the discharge vessel within the outer envelope and to further improve lamp photometrics, a containment shield 30 surrounds the discharge vessel and includes a vitreous light-transmissive sleeve 31 and a length of helically coiled wire 32 coiled about the sleeve. The sleeve may consist of, for example, hard glass or quartz glass (fused silica). (FIG. 2)

Figure 1:
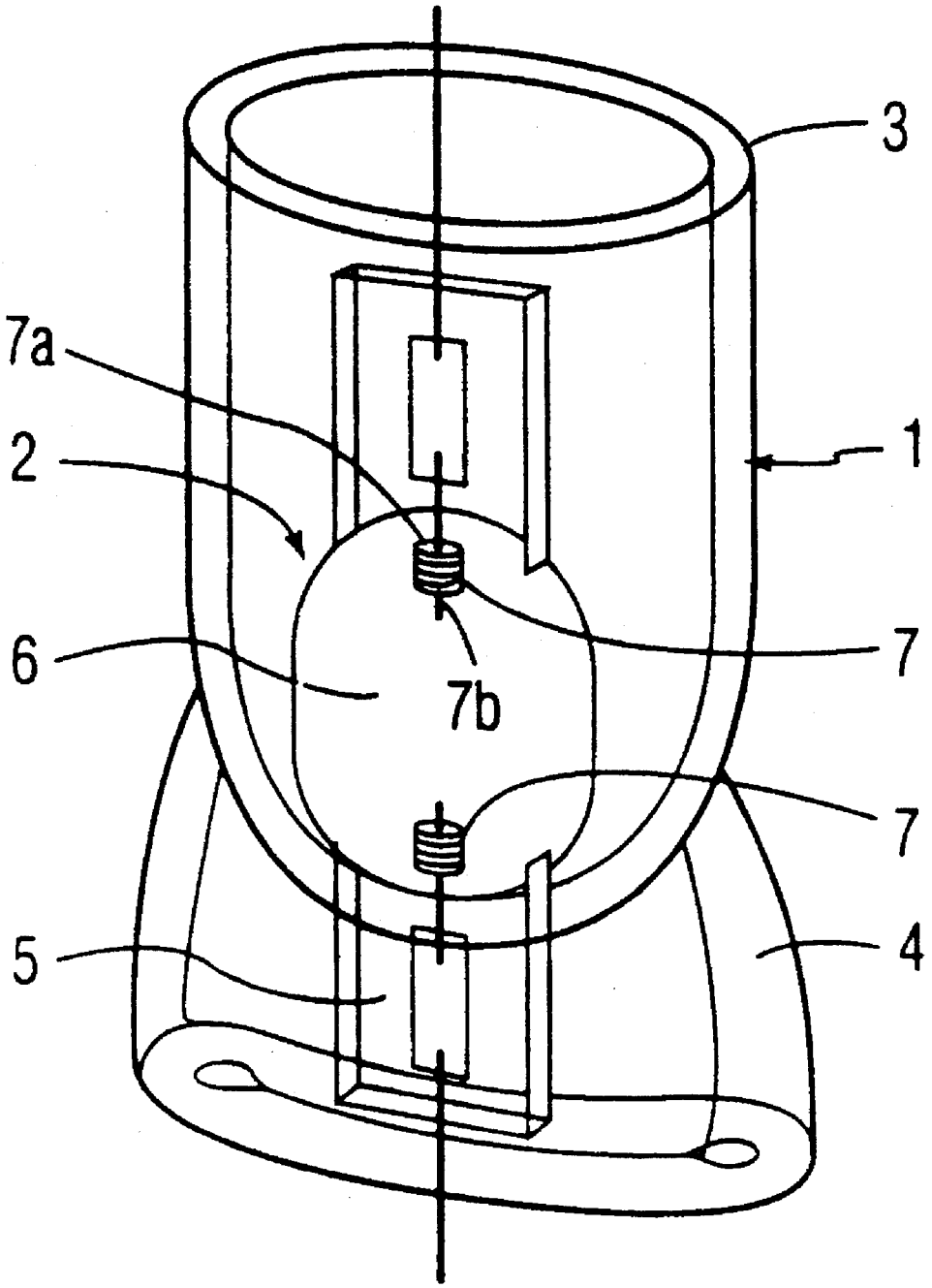
FIG. 1 PRIOR ART
FIG. 1 is perspective view of a low-wattage metal halide discharge vessel according to the prior art.

The sleeve 31 has an inner diameter, over a major portion of its length, which is only slightly larger than the largest width dimension between the side faces, allowing the sleeve to be readily positioned over the discharge vessel. The ends of the sleeve are pinched against ends of the side faces of the press seals to axially capture the discharge vessel within the sleeve. This is accomplished by heating the ends of the sleeve opposite the minor seal faces 14*c*, 14*d* to its softening temperature and allowing it to just collapse onto the minor faces or by gently pressing the softened glass against the minor faces with suitable jaws. This may be done in a high speed manner. As a result of this, the sleeve includes indentations 31*a* which extend along the edge of the press seal side faces and portions 31*b* pressed against the end of the respective side faces. (FIG. 4) With the sleeve fused to the ends or corners of the seal, which are the coolest part of the seal, less heat is conducted from the discharge vessel to the sleeve 31 than if the sleeve is fused across the major faces of the press seal as shown in the prior art lamp of FIG. 1. Additionally, both sleeve ends remain open and are symmetrical, so that the temperature distribution of the arc tube will be substantially the same whether the arc tube is operated base-up or base-down, in contrast to the prior art lamp of FIG. 1. Thus, the constructional advantages associated with pinching the sleeve to the press seals are retained while conduction of heat away from the discharge vessel is minimized.

The helically coiled metal wire 32 is fixed around the sleeve by its own clamping force and is electrically floating. Bent end portions 32*a* engage over the ends of the sleeve to further axially secure it on the sleeve. To achieve this, for example, resistance wire may be used, for example, of kanthal, tantalum, molybdenum, or stainless steel wire. In the lamp shown, molybdenum wire of 0.60 mm diameter is used, coiled with a pitch of 5 mm. The coiled wire is thin and has an open structure. Influence on the luminous flux of the lamp, therefore, is scarcely perceivable.

The wire surrounding the tube is electrically floating. Disappearance of sodium, if present, from the discharge vessel is effectively counteracted by this. If an electron should be ejected from the wire by UV radiation, the wire is given a positive potential which slows down further electron losses.

It was found that the construction is sufficiently effective and reliable when the wire surrounds the pair of electrodes, i.e. the cavity of the discharge vessel, laterally.

The sleeve is electrically isolated from the lamp frame because no metallic straps secure the sleeve to the conductive support rods 27 and neither the sleeve 31 nor the metal coiled wire 32 contact any portion of the metallic lamp frame.

Because of the helical wire, the tube may have a reduced wall thickness of, for example, about 1 mm and provide the same level of containment as the sleeve according to the above-mentioned U.S. Pat. No. 5,136,204, in which the commercially available embodiment had a wall thickness of 2 mm. With the coiled wire and the 1 mm sleeve, the containment shield 30 has a weight which is about half that of the prior art 2 mm sleeve. This weight reduction allows the sub-assembly of the discharge vessel and containment shield to be supported solely by the feed-throughs 18 and straps 27*c*, 27*d*. In the lamp shown, the feed-throughs 18 are 0.60 mm in molybdenum wire, the lower straps 27*d* is 0.025 mm by 0.16 mm nickel, and the upper strap 27*c* is a stainless steel wire having a diameter of 0.16 mm.

The above construction is attractive because the discharge vessel 11, sleeve 31, and wire 12 can be provided during lamp assembly as a completed sub-assembly. The sub-assembly is then easily connected to the frame by welding the ends of the conductive feed-throughs 18 to the conductive support straps 27*c*, 27*d*, which are part of the conductive support rods. The use of clips on the press seal or straps about the sleeve which are welded to the support rod, as in U.S. Pat. Nos. 5,136,204 and 4,721,876, are eliminated, thus reducing lamp cost.

THE FILAMENT ELECTRODES

Figures 5A, 5B:
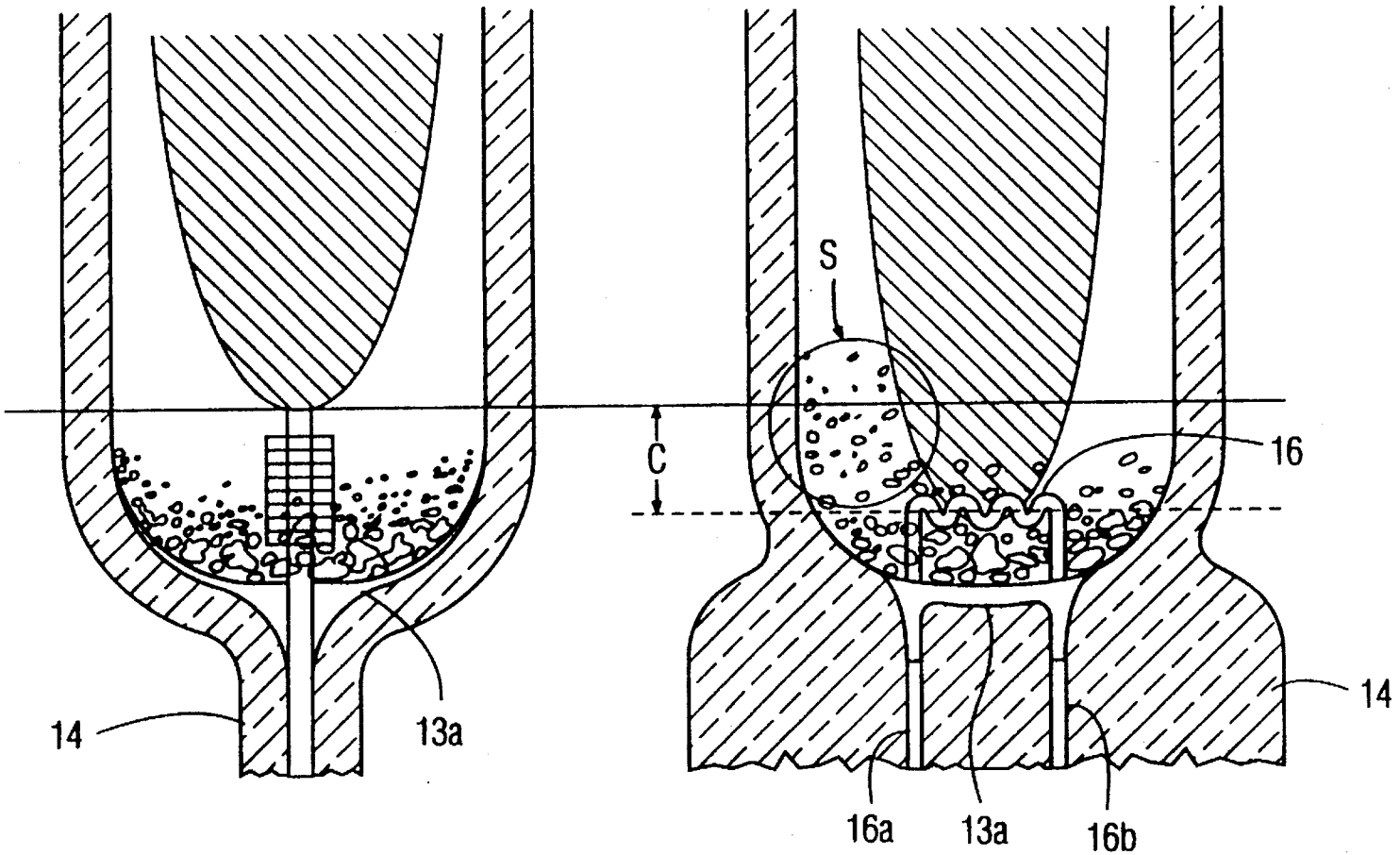
FIG. 5A PRIOR ART
FIG. 5*a* is a cross-section of a portion of a straight-body discharge vessel with a conventional electrode.
FIG. 5*b* is a cross-section of a portion of straight-body discharge vessel with a filament electrode according to the invention.

The effectiveness of the filament electrode is observable by viewing the lamp in operation after it has stabilized. A prior art metal halide lamp having a conventional electrode and straight body arc tube is shown in FIG. 5A. FIG. 5B shows the identical arc tube but with a filament electrode according to the invention. The arc tube of FIG. 5B is rotated 90° with respect to FIG. 5A to more clearly show the filament. Parts corresponding to the discharge vessel of FIG. 3 have the same reference numerals. The region adjacent the end wall 13*a* includes the excess salts which have pooled in the crevices adjacent the press seals, as previously discussed.

The top of the coil body 16 (on which the discharge arc terminates) of the filament electrode is retracted into the end chamber much further than the distal tip of the conventional electrode. For 100 W lamps, the distal tip of the conventional electrode was inserted a distance of about 4.5 mm from the end wall 13*a* whereas the top of the filament coil was spaced a distance of about 1.8 mm from the end wall 13*a*. Thus, the discharge arc is withdrawn further into the end chamber by a distance "C" of about 2.7 mm for the filament electrode verses the standard electrode.

With the prior art discharge vessel in a vertical operating position within a gas-filled outer envelope (without a sleeve or an end coat), the metal halide salts will condense on the wall of envelope in the lower end chamber at an axial location behind the electrode tip as illustrated in FIG. 5A. By contrast, the much deeper retraction of the arc into the end chamber by the filament electrode heats the end chamber sufficiently so that the salts are "chased" up the wall from behind the electrode so that the region on the inner wall at which the salts condense (denoted by "S" in FIG. 5B) is primarily in the axial region between the two filament electrodes. The remaining droplets shown beneath the electrode are present in the observed lamp but are not in the region at which the salts condense. Rather, they are droplets which have run down the wall after condensing due to gravity. This "chasing" indicates that the end chamber has a higher temperature and that the partial pressures of the metal halides is greater for the lamp having the filament electrode than the standard electrode. Consequently, the filament electrode should provide improved photometric performance.

It should be noted that end coats of ZrO2 are typically applied in a zone which does not extend past the tip of the standard electrode because they are opaque and will block light from the discharge. With such an end coat, the salts may be "chased" up the discharge vessel wall to a similar extent as with a filament electrode. However, because of the length dimension of the filament electrode, the major portion of the area on which the salts condense will still be behind the electrode tip.

The effectiveness of the filament electrodes at improving photometric performance was quantified by fabricating four groups of 100 W metal halide lamps with straight body discharge vessels as shown in FIG. 3. The group 1 lamps had conventional electrodes and a conventions $ZrO_2$ end coat, the group 2 lamps had conventional electrodes and no end coat, the group 3 lamps had filament electrodes and no end coat, and the fourth group had filament electrodes and a $ZrO_2$ end coat. None of the lamps had sleeves. The filament electrodes had the following dimensions:

| | | |
|---|---|---|
| W = | Wire diameter: | 0.25 mm |
| M — | Mandrel diameter: | 0.30 mm |
| | Number of turns: | 6 |
| P — | Pitch: | 0.35 mm |
| | Filament weight: | 23.0 mg |

The axis of the coil was spaced 1.5 mm from the end wall and the arc gap, dimension A in FIG. 3, was 17 mm. The conventional electrode had a distance from its tip to the end wall of 4.5 mm and an arc gap of 13.5 mm. All lamps included a $NaI/ScI_3$ fill in a mole ratio of 19:1.

The configurations and the corresponding initial photometric results (100 hr.) are shown in Table I below.

TABLE I

| Group | Electrode | $ZrO_2$ | LPW | CCT | CRI |
|---|---|---|---|---|---|
| 1 | Standard | Yes | 80 | 4100 | 60 |
| 2 | Standard | No | 75 | 4900 | 55 |
| 3 | Filament | No | 80 | 4100 | 60 |
| 4 | Filament | Yes | 85 | 3800 | 65 |

As shown in Table I, for lamps having a conventional (standard) electrode, the end coat provides an increase in efficacy of about 5 LPW and an increase in color rendering of about 5 CRI. Lamps (Group 3) having a filament electrode and no end coat had the same initial performance as the Group 1 lamps, which are considered standard quality. Thus, the filament electrode improves lamp performance by about the same amount as the heat conserving end coat. Consequently, the measured performance agrees with the observed "chasing" effect discussed above. By using the filament electrode the end coat can be eliminated while achieving the same initial photometric performance as a standard lamp with conventional electrodes. This is advantageous because a filament electrode costs no more than a conventional electrode and is easier to handle, while eliminating the end coat reduces lamp cost and reduces lamp-to-lamp variations in photometric parameters. Alternatively, by using an end coat with a filament electrode (Group 4), lamp performance is improved over a standard lamp (Group 1) having an end coat and a conventional electrode.

In another group of lamps having the same configuration as the group 3 lamps above but with a mole ratio $NaI/ScI^3$ of 11.3:1, the luminous efficacy, color rendering, and color temperature at 100 hours was 85 LPW, 61 CRI and 4200° K., respectively. For this group, the color rendering improved to 68 at 5000 hours.

Additionally, the lumen maintenance at 5000 hours for the group 3 configuration was 50% for the lamps having the $NaI/ScI^3$ mole ratio of 19:1 and a 52% for the lamps having the $NaI/ScI^3$ mole ratio of 11.3:1. The group 1 lamp of Table I with a conventional thoriated electrode had a lumen maintenance of 52%. Thus, the lamps according to the invention have a lumen maintenance which is substantially no worse than the conventional lamp while being free of radioactive thoria in the lamp fill and electrode.

Figure 4:
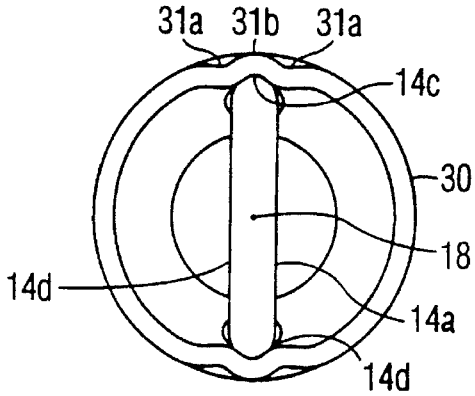
FIG. 4 is an end view showing the pinching of the containment sleeve to the press seal.

In other tests, the addition of the sleeve pinched to the discharge vessel in the manner shown in FIGS. 2 and 4 provided an increase in luminous efficacy of about 5 LPW and an increase in color rendering of about 5 CRI, which is the same as that provided by the end coat.

To further determine the effectiveness of the lamp construction for low wattage metal lamps, 50 W lamps as shown in FIG. 2 having a sleeve but no end coat were fabricated. The discharge vessels were made from tubes of fused silica having an internal diameter of 6.0 mm. The discharge vessels had an average cavity length (dimension "B" in FIG. 3) of 14.7 mm and an arc gap average of 9.8 mm (dimension "A" in FIG. 3) The volume of the discharge space was about 459 $mm^3$. The lamps were dosed with 4 mg of mercury and 6 mg of preformed $NaI/ScI^3$ iodide at a mole ratio of 16:1 and argon at 200 torr fill pressure. The filament electrodes had the dimensions previously listed. Table II below lists the photometric results for these lamps.

TABLE II

| Hours | Volts | LPW | % LPW | x | y | CCT | CRI |
|---|---|---|---|---|---|---|---|
| 100 | 94 | 64 | 100 | 369 | 373 | 4310 | 58 |
| 1000 | 96 | 58 | 91 | 378 | 373 | 4097 | 60 |
| 2000 | 97 | 52 | 81 | 377 | 371 | 4082 | 60 |
| 5000 | 98 | 46 | 72 | 375 | 371 | 4112 | 62 |

As seen from Table II, the lamps achieved the design goal of standard quality photometrics for a 50 W lamp of about 65 LPW and about 60 CRI at 100 hours. Additionally, these lamps had a lumen maintenance at 5000 hours of 72%, which is significantly better than the 52% achieved for the standard 100 W lamp with thoriated electrodes. This is significant because the discharge vessels were of the "straight-body" type fabricated from straight tubing using conventional press sealing and tubulation techniques and did not have an end coat. 50 W metal halide lamps having such a straight body discharge vessel are not commercially available. Furthermore, these photometric results for 50 W lamps according to the invention are comparable with commercially available 50 W lamps of the formed body type with end coat.

THE CONTAINMENT SHIELD

To test the effectiveness of the containment shield, the discharge vessel was made to explode by means of a current surge. The outer envelope Was a standard, commercially available BD-17 bulb having a wall thickness which varies from about 0.6 mm to about 1 mm. The outer bulb remained entirely undamaged during this, which proves that the construction of the lamp effectively protects the surroundings against the consequences of an explosion of the discharge vessel even though the wall thickness of the sleeve was only about 1 mm and the outer envelope was of standard thickness. Using the same tests, the prior art lamp of FIG. 1 in which the sleeve was fused to the major faces of the sleeve suffered breakage of the outer envelope even though its wall thickness was significantly greater, at about 2 mm.

Additionally, the lamp was drop tested to ensure the ruggedness of the fixation between the wire 32, the sleeve 31 and discharge vessel 11 as well as between the above sub-assembly and the frame at the welds between the conductive feed-throughs 8 and the conductive support rods *27a, 27b* and straps *27c, 27d*. In this standard drop test an outer cardboard box containing twelve (12) lamps in their commercial packaging is dropped a total of ten times from a height of thirty inches: six times with each one of the flat sides coming down first, twice with an edge coming down first, and twice with a corner coming down first. The lamps are then checked for breakage, bending of stem rods, etc. None of the lamps according to the invention were found to fail.

The lamp according to the invention accordingly comprises a combination of features and the inter-relationship of each of these features with respect each of the others by which a cost reduced lamp having commercially acceptable, photometrics is attained. The filament electrode permits cost reduction of the discharge vessel by permitting the use of a straight-body arc tube and the elimination of the end coat. With the filament electrodes therein and its compounds can be eliminated from the electrode and the discharge vessel fill without detrimentally affecting lumen maintenance. The pinched containment sleeve construction is sufficiently lightweight that the discharge vessel and sleeve can be supported as a sub-assembly by the discharge vessel feed-throughs, eliminating expensive clips, straps while being totally effective to prevent failure in standard thickness outer envelope and while minimizing heat conduction away from the end chambers of the discharge vessel.

Those of ordinary skill in the art will appreciate that various modifications may be made to the above described embodiments which are within the scope of the appended claims. For that purpose the description is to be understood to be illustrative only and not limiting. For example, the discharge vessel need not be of fused silica, but may consist of any of the well known ceramics used for discharge vessels, such as polycrystalline alumina.

What we claim is:

1. A high pressure discharge lamp comprising a discharge vessel having opposing end chambers and a longitudinal axis, a discharge sustaining filling within said discharge vessel, and a pair of opposing discharge electrodes arranged in said end chambers and between which an arc discharge is maintained during lamp operation, characterized in that:

said discharge electrodes each consist of an open elongate filament of refractory metal wire having a plurality of successive coil turns extending transverse to the longitudinal axis of said discharge vessel and on which the discharge arc terminates during lamp operation, and the dimensions of the electrode and the spacing of the coil turns from the end chamber being selected such that the discharge arc sufficiently heats the end chamber during lamp operation so that the fill constituents primarily condense on the discharge vessel at a location axially between the discharge electrodes with (i) the discharge vessel oriented vertically in a gas filled outer envelope and (ii) with the discharge vessel being free of a heat conserving end coat and free of a sleeve thereabout.

2. A high pressure discharge lamp according to claim 1, wherein said filament is free of thoria, and said discharge sustaining fill is free of metals of low work function which are pyrolitically decomposable and subject to plating out on said electrodes.

3. A high pressure discharge lamp according to claim 2, wherein said discharge vessel is free of a heat-conserving coating about said electrodes.

4. A high pressure discahrge lamp according to claim 3, wherein said filament electrode is dimensioned such that the discharge arc terminates thereon within about 2 mm of the end chamber wall measured along the longitudinal axis of the discharge vessel.

5. A high pressure discharge lamp according to claim 1, wherein said discharge vessel is free of a heat-conserving coating about said electrodes.

6. A high pressure discharge lamp according to claim 5, wherein said filament electrode is dimensioned such that the discharge arc terminates thereon within about 2 mm of the end chamber wall measured along the longitudinal axis of the discharge vessel.

7. A high pressure discharge lamp according to claim 1, wherein said filament electrode is dimensioned such that the discharge arc terminates thereon within about 2 mm of the end chamber wall measured along the longitudinal axis of the discharge vessel.

8. A high pressure discharge lamp, comprising:

a) an outer envelope;

b) a discharge vessel within said outer envelope, said discharge vessel consisting of fused silica and including a tubular body portion of substantially constant cross section defining a longitudinal axis of the discharge vessel, seals at each end sealing the discharge vessel in a gas-tight manner, and end chambers of continuously reducing cross-section extending between said tubular body portion and each of said seals, said end chambers each including an end wall lying on the longitudinal axis of the discharge vessel;

c) a discharge electrode mounted in each end chamber between which an arc discharge is maintained during lamp operation, each discharge electrode being free of thoria and comprising a filament of refractory metal wire having a plurality of successive open coil turns extending transverse to the longitudinal axis, said filament being dimensioned such that said discharge arc terminates thereon within about 2 mm of the end wall of the discharge vessel;

d) a discharge sustaining filling within said discharge vessel, said discharge sustaining filling being free of metals of low work function which are pyrolitically decomposable and subject to plating out on said electrodes during lamp operation; and e) means for supporting said discharge vessel within said outer envelope and for connecting said discharge electrodes to a source of electric potential outside of said lamp envelope.

9. A high pressure discharge lamp according to claim 8, wherein said lamp is a metal halide discharge lamp and said discharge sustaining fill comprises mercury, a rare gas, and a metal halide.

10. A high pressure discharge lamp according to claim 8, wherein said discharge vessel is free of a heat-conserving coating on said end chambers.

11. A high pressure discharge lamp according to claim 10, further comprising a light-transmissive sleeve arranged about said discharge vessel for increasing the temperature of said discharge vessel during lamp operation.

12. A high pressure discharge lamp according to claim 8, wherein said discharge vessel is free of a heat-conserving coating on said end chambers.

13. A high pressure discharge lamp according to claim 8, further comprising a light-transmissive sleeve arranged about said discharge vessel for increasing the temperature of said discharge vessel during lamp operation.

14. A metal halide discharge lamp, comprising:

a) an outer envelope sealed in a gas-tight manner;

b) a discharge vessel arranged within said outer envelope, said discharge vessel comprising (i) a body of fused silica having a tubular portion of substantially constant cross section defining a longitudinal axis of the discharge vessel, opposing planar seals sealing the discharge vessel in a gas-tight manner, and end chambers of continuously reducing cross-section extending between said tubular portion and each of said seals, (ii) a discharge electrode mounted in each end chamber between which an arc discharge is maintained during lamp operation, each discharge electrode comprising a filament of refractory metal wire having a plurality of successive coil turns extending transverse to the longitudinal axis, said discharge electrodes being free of thoria, (iii) conductive feed-throughs connected to each filament and extending through a respective seal in a gas-tight manner, and (iv) a discharge sustaining filling within said discharge vessel comprising mercury, a rare gas and one or more metal halides, said discharge sustaining filling being free of metals of low work function which are pyrolitically decomposable and subject to plating out on said electrodes during lamp operation;

c) a light transmissive sleeve arranged about said discharge vessel; and c) frame means for supporting said sleeve and discharge vessel within said outer envelope and for connecting said feed-throughs to a source of electric potential outside of said lamp envelope.

15. A metal halide discharge lamp according to claim 14, wherein said press seals each include a pair of opposing major faces and a pair of opposing minor faces extending between said major faces, and said sleeve is pinched against said discharge vessel along only the minor faces of each of said press seals and is open at both ends thereof.

16. A metal halide discharge lamp according to claim 15, further comprising a coiled length of wire arranged about said sleeve, said sleeve and said wire being selected for containing fragments of said discharge vessel and preventing failure of the outer envelope in the event of discharge vessel rupture.

17. A metal halide discharge lamp according to claim 16, wherein said discharge vessel and sleeve pinched thereto are secured to said frame means solely by said discharge vessel feed-throughs.

18. A metal halide discharge lamp according to claim 15, wherein said sleeve is pinched against said discharge vessel only at the ends of said minor faces.

19. A metal halide discharge vessel according to claim 15, wherein said end chambers of said discharge vessel are free of heat-conserving coatings.

20. A metal halide discharge lamp according to claim 19, wherein said metal halide lamp has a rated wattage of about 50 W, an initial color rendering of at least about 60 CRI and an initial luminous efficacy of at least about 65 LPW.

21. A metal halide discharge lamp according to claim 20, wherein said fill includes the iodides of sodium and scandium in a mole ratio of sodium iodide to scandium iodide of between about 11.3:1 and about 19:1.

22. A metal halide discharge lamp according to claim 21, wherein said metal halide lamp has a lumen maintenance in which the luminous efficacy at 5000 hours of lamp operation is greater than about 50 percent of the luminous efficacy at 100 hours of lamp operation.

23. A metal halide discharge lamp according to claim 20, wherein said metal halide lamp has a lumen maintenance in which the luminous efficacy at 5000 hours of lamp operation is greater than about 50 percent of the luminous efficacy at 100 hours of lamp operation.

24. A metal halide discharge vessel according to claim 15, wherein said end chambers of said discharge vessel include heat-conserving end coatings.

25. A metal halide discharge lamp according to claim 15, wherein said metal halide lamp has a rated wattage of about 50 W, an initial color rendering of at least about 60 CRI and an initial luminous efficacy of at least about 65 LPW.

26. A metal halide discharge lamp according to claim 25, wherein said fill includes the iodides of sodium and scandium in a mole ratio of sodium iodide to scandium iodide of between about 11.3:1 and about 19:1.

27. A metal halide discharge lamp according to claim 26, wherein said metal halide lamp has a lumen maintenance in which the luminous efficacy at 5000 hours of lamp operation is greater than about 50 percent of the luminous efficacy at 100 hours of lamp operation.

28. A metal halide discharge lamp according to claim 15, wherein said metal halide lamp has a lumen maintenance in which the luminous efficacy at 5000 hours of lamp operation is greater than about 50 percent of the luminous efficacy at 100 hours of lamp operation.

29. A metal halide discharge lamp comprising a sealed discharge vessel having a pair of discharge electrodes between which an arc discharge is maintained during lamp operation and a discharge sustaining fill within said discharge vessel including mercury, a metal halide, and a rare gas, characterized in that:

said electrodes each consist of an open elongate filament of refractory metal wire having a plurality of successive coil turns extending transverse to the longitudinal axis of the discharge vessel and on which the discharge arc terminates during lamp operation, and said filament is free of thoria and thoria containing emission materials, and said discharge sustaining fill is free of metals of low work function which are pyrolitically decomposable and subject to plating out on said electrodes.

30. A metal halide discharge lamp according to claim 29, wherein said fill includes the iodides of sodium and scandium in a mole ratio of sodium iodide to scandium iodide of between about 11.3:1 and about 19:1.

31. A metal halide discharge lamp according to claim 30, wherein said metal halide lamp has a lumen maintenance in which the luminous efficacy at 5000 hours of lamp operation is greater than about 50 percent of the luminous efficacy at 100 hours of lamp operation.

32. A metal halide discharge lamp according to 31, wherein said metal halide lamp has rated wattage of about 50 W, an initial color rendering of at least about 60 CRI and an initial luminous efficacy of at least about 65 LPW.

33. A metal halide discharge lamp according to claim 31, wherein said metal halide lamp has a rated wattage of about 100 W, an initial color rendering of at least about 60 CRI and an initial luminous efficacy of at least about 80 LPW.

34. A high pressure discharge lamp, comprising:

a) an outer envelope;

b) a discharge vessel within said outer envelope, said discharge vessel consisting of fused silica and including a tubular body portion of substantially constant cross section defining a longitudinal axis of the discharge vessel, seals at each end sealing the discharge vessel in a gas-tight manner, and end chambers of continuously reducing cross-section extending between said tubular body portion and each of said seals, said end chambers each including an end wall lying on the longitudinal axis of the discharge vessel;

c) a discharge electrode mounted in each end chamber between which an arc discharge is maintained during lamp operation, each discharge electrode comprising a filament of refractory metal wire having a plurality of successive open coil turns extending transverse to the longitudinal axis, said filament being dimensioned such that said discharge arc terminates thereon within about 2 mm of the end wall of the discharge vessel;

d) a discharge sustaining filling within said discharge vessel;

e) means for supporting said discharge vessel within said outer envelope and for connecting said discharge electrodes to a source of electric potential outside of said lamp envelope; and f) a light-transmissive sleeve arranged about said discharge vessel for increasing the temperature of said discharge vessel during lamp operation.

* * * * *